United States Patent [19]

Okabe et al.

[11] Patent Number: 4,561,824

[45] Date of Patent: Dec. 31, 1985

[54] HYDRAULIC DRIVE SYSTEM FOR CIVIL ENGINEERING AND CONSTRUCTION MACHINERY

[75] Inventors: Nobuya Okabe; Fumiki Nakagiri, both of Tsuchiura, Japan

[73] Assignee: Hitachi, Ltd., Tokyo, Japan

[21] Appl. No.: 354,386

[22] Filed: Mar. 2, 1982

[30] Foreign Application Priority Data

Mar. 3, 1981 [JP] Japan ..... 56-29320
Feb. 24, 1982 [JP] Japan ..... 57-28556

[51] Int. Cl.[4] ..... F15B 11/20

[52] U.S. Cl. ..... 414/697; 91/6; 91/31; 91/523; 91/530; 91/531

[58] Field of Search ..... 91/6, 31, 510, 523, 91/531, 530; 60/484, 486; 414/697

[56] References Cited

U.S. PATENT DOCUMENTS

| | | | |
|---|---|---|---|
| 2,912,131 | 11/1959 | Jung et al. | 91/523 |
| 3,641,876 | 2/1972 | Wienke | 91/6 |
| 3,720,059 | 3/1973 | Schurawski | 91/531 |
| 3,922,855 | 12/1975 | Bridwell et al. | 60/486 |
| 3,922,954 | 12/1975 | Gustofsson et al. | 91/531 |
| 4,023,364 | 5/1977 | Bianchetta | 60/484 |
| 4,112,821 | 9/1978 | Bianchetta | 91/6 |
| 4,142,445 | 3/1979 | Lohbauer | 91/6 |
| 4,207,740 | 6/1980 | Ripa | 91/530 |

*Primary Examiner*—Abraham Hershkovitz

*Assistant Examiner*—Richard S. Meyer

*Attorney, Agent, or Firm*—Antonelli, Terry & Wands

[57] ABSTRACT

A hydraulic drive system for civil engineering and construction machinery in which at least first and second hydraulic circuits having at least first and second hydraulic pumps, respectively, are provided for driving a plurality of actuators such as left and right travelling actuators, a boom actuator and an arm actuator. The first circuit includes a first travelling directional control valve for one of the left and right travelling actuators located downstream of a first boom directional control valve for the boom actuator and a first arm directional control valve for the arm actuator that the latter to receive a hydraulic fluid supply from the first pump by taking priority over the first travelling valve. The second circuit includes a second travelling directional control valve for the other of the left and right travelling actuators upstream of a second boom directional control valve for the boom actuator and/or a second arm directional control valve for the arm actuator so as to be able to receive hydraulic fluid supply from the second pump by taking priority over the second boom and/or arm valves. A bypass circuit extends between the second pump and the one travelling actuator whereby a hydraulic fluid supply from the second pump can be received by the first travelling valve.

20 Claims, 5 Drawing Figures

HYDRAULIC DRIVE SYSTEM FOR CIVIL ENGINEERING AND CONSTRUCTION MACHINERY

BACKGROUND OF THE INVENTION

This invention relates to hydraulic drive systems for civil engineering and, construction machinery, and more particularly, to a hydraulic drive system suitable for use with divil enginering and cnstruction machinery provided with a plurality of working elements, such as hydraulic shovels.

Generally, a hydrauic shovel is provided with a plurality of working elements including a swing, left and right travelling members, a boom, an arm and a bucket which are adapted to be driven by respective hydraulic actuators such as a swing motor, left and right travelling motors, a bom cylinder, an arm cylinder and a bucket cylinder of a hydraulic drive system. The hydraulic drive system generally comprises at least two hydraulic circuits each having a hydrauic pump mounted therein, and a valve group comprising a plurality of directional control valves for controlling the flow of hydraulic fluid supplied to the associated actuators from the pump to thereby control the operation of the actuators. Heretofore, the directional control valve of each valve group has been provided with a center bypass line, with the control valves being corrected in parallel with respect to the associated hydraulic pump.

The parallel connection of the directional control valves enables the hydraulic circuits to be simplified in construction and permits a plurality of actuators to be simultaneously driven. However, when a plurality of actuators are simultaneously driven for combined operations, difficulties are experienced in effecting control accurately because actuator operations are mutually influenced by the working pressure thereof. For example, when the hydraulic shovel is travelling straightforwardly by actuating the left and right travelling motors connected to the two hydraulic pumps respectively, if an attempt is made to actuate the swing motor, boom cylinder, arm cylinder or bucket cylinder connected in parallel with one of the travel motors, then the hydraulic shovel would travel in zigzag fashion. Moreover, when an inordinately large difference in working pressure between actuators performing combined operations is caused due to varying load conditions applied to the actuators, the hydraulic fluid would flow only to the actuator of lower working pressure and the other actuator or actuators would be rendered inoperative.

To avoid the aforesaid problems arising from the parallel connection of the directional control valves, proposals have recently been made to connect the plurality of directional control valves of each hydraulic circuit in tandem to ensure that each actuator in the circuit operates independently. One example of such proposals is described in U.S. Pat. No. 4,112,821.

The hydraulic drive system disclosed in this U.S. patent comprises a first hydraulic circuit and a second hydraulic circuit connected together at specific points therein through a first bypass line, a second bypass line and a third bypass line, one of such two circuits having specific points therein connected together through a fourth bypass line. The system further comprises a control valve and on-off valves associated with the first to third bypass lines and responsive to actuation of the predetermined directional control valves. By this constructional feature, the system aims at enabling actuators to perform combined operations to a certain extent and ensuring that the actuators operate independently of one another by virtue of the tandem connection of the directional control valves. However, this hydraulic drive system can perform only a relatively small number of types of combined operations and consequently the system has had practical value only in a relatively limited number of applications.

For example, in the second hydraulic circuit, the boom directional control valve is connected in tandem to the right travelling directional valve on the downstream side of the latter. This arrangement makes it impossible to supply hydraulic fluid simultaneously to the right travelling motor and the boom cylinder, so that it is impossible to perform travelling and boom combined operations.

The provision of the fourth bypass line enables hydraulic fluid to be simultaneously supplied to the left travelling motor and the arm cylinder thereby to permit travel and arm combined operations to be performed. However, the left travelling motor and the arm cylinder would be mutually influenced by the working pressures thereof, so that when the left travelling motor has a lower working pressure the arm would not operate. For example, when the hydraulic shovel travels downhill, the working pressure of the left travelling motor drops and makes it impossible for the arm to operate simultaneously. Also, when the hydraulic shovel tries to escape from the muddy ground, the operator of the hydraulic shovel intends to drive the travelling members forwardly by pulling the arm toward him. In such case, it would be impossible for the hydraulic shovel to escape from the muddy ground because of low working pressure of the travelling motors. Also, when it is desired to raise the arm whie trvelling after lifting an article with the bucket, it would be impossible to attain the end of raising the arm if the arm holding pressure is raised above a certain level by the weight of the bucket.

In the hydraulic drive system of the aforesaid construction, the boom directional control valve is connected in tandem with the bucket directional valve on the downstream side of the latter. This makes it impossible to perform simultaneously combined boom, arm and bucket operations and simultaneous combined swivelling, boom, arm and bucket operations. Also, the arrangement whereby the boom directional control valve is connected to the travelling motor on the downstream side of the latter makes it impossible to simultaneously combined perform travelling, boom and arm operations and simultaneously combined swivelling, travelling and boom operations.

Moreover, in the hydraulic drive system of the aforesaid construction, the problem is additionally raised that although simultaneous combined swing and boom operations can be performed independently of each other, relief occurs in the hydraulic circuit during acceleration of the swing because of its high inertia, so that the system woud have a high energy loss.

SUMMARY OF THE INVENTION

An object of this invention is to provide a hydraulic drive system for civil engineering and construction machinery capabe of performing simultaneous combined and boom operations and/or simultaneous combined travelling and arm operations independently of each other.

Another object is to provide a hydraulic drive system for civil engineering and construction machinery capable of simultaneously performing three combined operations including boom, arm and bucket operations and four combined operations including swing, boom, arm and bucket operations.

Still another object is to provide a hydraulic drive system for civil engineering and construction machinery capable of simultaneously performing three combined operations including travelling, boom and arm operations and another three simultaneous combined operations including swing, travelling and boom operations.

Still another object is to provide a hydraulic drive system for civil engineering and construction machinery capable of avoiding the occurrence of relief due to inertia of a swing when swing and boom simultaneous combined operations are performed, thereby enabling effective utilization of energy to be achieved for raising the boom.

A further object is to provide a hydraulic drive system for civil engineering and construction machinery enabling a plurality of actuators to perform simultaneous combined operations by actuating them in a variety of combinations while allowing the combined operations to be performed substantially independently of one another to a certain degree.

To accomplish the aforesaid objects, according to the invention a hydraulic drive system for civil engineering and construction machinery is provided which comprises at least first and second hydraulic fluid circuits for driving a plurality of hydraulic actuators, the first circuit including a first hydraulic pump, and a first valve group having a plurality of directional control valves for controlling flow of hydraulic fluid from the first pump to the actuators associated therewith, and the second circuit including a second hydraulic pump, and a second valve group having a plurality of directional control valves for controlling flow of hydraulic fluid from the second pump to the actuators associated therewith. The plurality of hydraulic actuator include at least left and right travelling actuators, a boom actuator and an arm actuator, with the first valve group including a first travelling directional control valve for controlling flow of hydraulic fluid to one of the left and right travelling actuators, a first boom directional control valve for controlling flow of hydraulic fluid to the boom actuator, and a first arm directional control valve for controlling flow of hydraulic fluid to the arm actuator. The first boom and arm directional control valves are connected to the first pump in a position upstream of the first travelling directional control valve in the first circuit so as to be able to receive a hydraulic fluid supply from the first pump by taking priority over the first travelling directional control valve. The second valve group includes a second travelling directional control valve for controlling flow of hydraulic fluid to the other of the left and right travelling actuators and a second boom directional control valve for controlling flow of hydraulic fluid to the boom actuator and/or a second arm directional control valve for controlling flow of hydraulic fluid to the arm actuator with the second travelling directional control valve being connected to the second pump in a position upstream of the second boom and/or arm directional control valves in the second circuit so as to be able to receive a hydraulic fluid supply from the second pump by taking priority over the second boom and/or arm directional control valves.

A bypass circuit is provided which includes including a bypass line extending between the second pump and the one travelling actuator, with the bypass circuit being effective to allow a hydraulic fluid supply from the second pump to be received by the first travelling actuator when at least one of the directional control valves of the first valve group upstream of the first travelling directional control valve which include the boom and arm directional control valves is actuated.

In a preferred embodiment of the invention, the first valve group may further include a swing directional control valve for controlling flow of hydrauic fluid to a swing actuator, the swing directional control valve being connected to the first pump in a position upstream of the first arm and travelling directional control valves in the first circuit so as to be able to receive a hydraulic fluid supply from the first pump by taking priority over the first arm and travelling directional control valves, and the first boom directional control valve is connected to the first pump through a bypass line connected to the first circuit in a position upstream of the swing directional control valve. The second valve group may include a bucket directional control valve for controlling flow of hydraulic fluid to the bucket actuator, the bucket directional control valve being connected to a bypass line connected to the second circuit in a position between the second travelling directional control valve and the second arm directional control valve.

In another preferred embodiment, the system may further comprise a third hydraulic circuit for driving a swing actuator, the third circuit including a third hydraulic pump and a swing directional control valve for controlling flow of hydraulic fluid from the third pump to the swing actuator, and the first arm directional control valve is connected to the first pump through a bypass line connected to the first circuit in a position upstream of the first boom directional control valve. The second valve group may further include a bucket directional control valve for controlling flow of hydraulic fluid to the bucket actuator, the bucket directional control valve being connected to a bypass line connected to the second circuit in a position between the second travelling directional control valve and the second boom directional control valve.

In still another preferred embodiment, the first travelling directional control valve may be connected to the first pump through a bypass line connected to the first circuit in a position upstream of the first boom and arm directional control valves, the bypass line having flow restricting means mounted therein. In case the first valve group further includes a swing directional control valve for controlling flow of hydraulic fluid to the swing actuator, the swing directional control valve being connected to the first pump in a position upstream of the first travelling directional control valve in the first circuit so as to be able to receive a hydraulic fluid supply from the first pump by taking priority over the first travelling directional control valve, the bypass line for the first travelling directional control valve may be connected to the first circuit in a position upstream of the swing directional control valve. The first arm directional control valve may be connected to a bypass line connected to the first circuit in a position between the swing directional control valve and the first boom directional control valve. The first arm directional control valve may be further connected to the first pump through a bypass line connected to the first circuit in a position upstream of the swing directional control valve, the bypass line having flow restricting means mounted therein.

DESCRIPTION OF THE PREFERRED EMBODIMENTS

Figure 1:
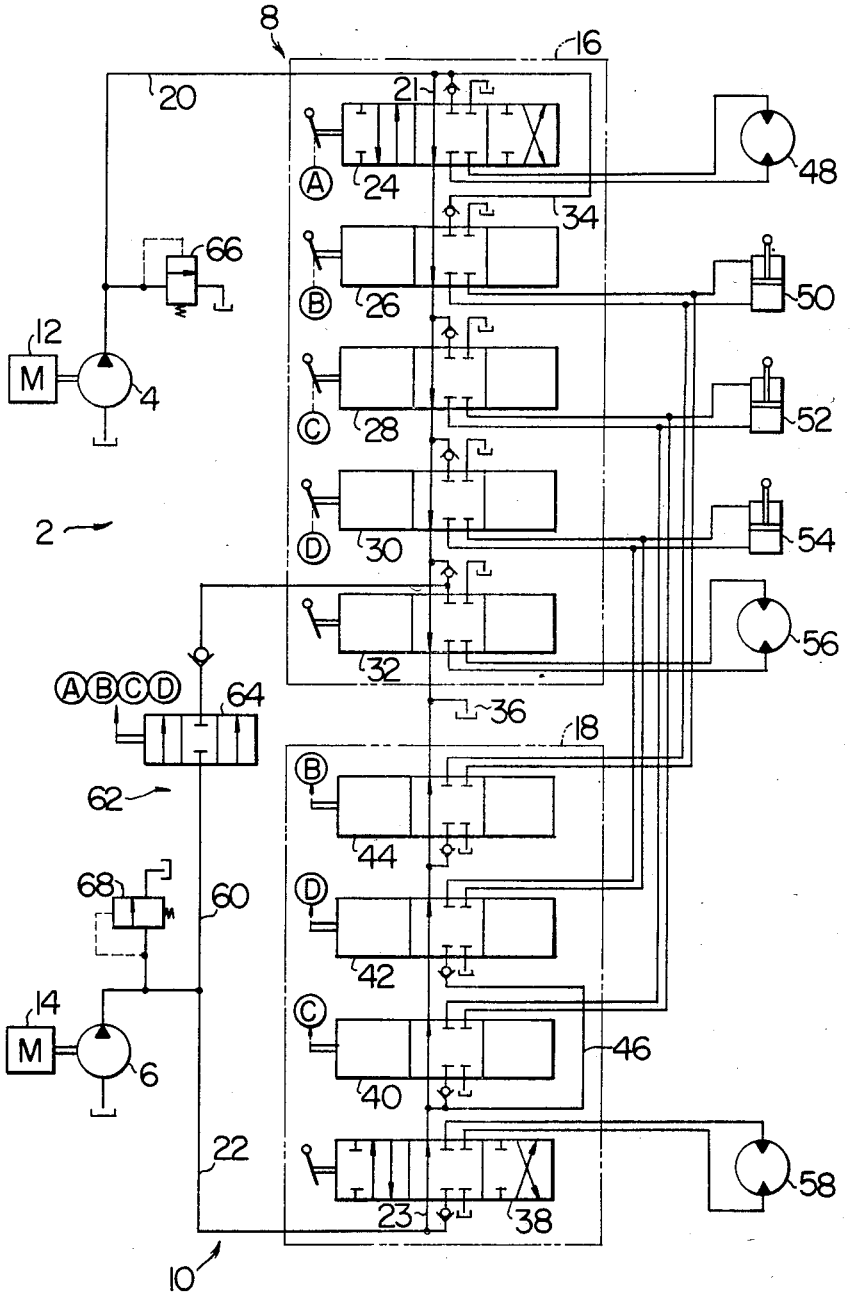
FIG. 1 is a circuit diagram of the hydraulic drive system comprising a first embodiment of the invention.

Referring now to the drawings wherein like reference numerals are used throughout the various views to designated like parts and, more particularly, to FIG. 1, according to this figure, a hydraulic drive system generally designated by the reference numeral 2 comprises a first hydraulic circuit generally designated by the reference numeral 8 includes a first hydraulic pump 4 and a second hydraulic circuit generally designated by the reference numeral 10 including a second hydraulic pump 6. The pumps 4 and 6 are driven by prime movers 12 and 14, respectively, which may be the same one or different ones.

The first hydraulic circuit 8 includes a first valve group 16 comprising a swing directional control valve 24, a first boom directional control valve 26, a first arm directional control valve 28, a first bucket directional control valve 30 and a left travelling directional control valve 32 which are connected to the first hydraulic pump 4 through a main line 20. In the first valve group 16, the valves 24, 26, 28, 30 and 32 are provided with a center bypass line 21 passing therethrough in the indicated order, the center bypass line 21 being connected at one end to the main line 20 and at the other end to a tank 36.

The second hydraulic circuit 10 includes a second valve group 18 comprising a right travelling directional control valve 38, a second arm directional control valve 40, a second bucket directional control valve 42 and a second boom directional control valve 44 which are connected to the second hydraulic pump 6 through a main line 22. In the second valve group, the valve 38, 40, 42 and 44 are provided with a center bypass line 23 passing therethrough in the indicated order, the center bypass line 23 being connected at one end to the main line 22 and at the other end to the tank 36.

In the first valve group 16, the swing directional control valve 24 has its inlet port connected to the center bypass line 21 in a position on the uppermost stream end thereof thereby to connect the valve 24 to the pump 4, and the first boom directional control valve 26 has its inlet port connected through a bypass line 34 to the center bypass line 21 in a position upstream of the valve 24 thereby to connect the valve 26 to the pump 4 in parallel with the valve 24. The first arm directional control valve 28, first bucket directional control valve 30 and left travelling directional control valve 32 have their inlet ports connected in the indicated order to the center bypass line 21 in a position downstream of the valve 26. Thus, it will be noted that the valves 24 and 26 are adapted to be able to receive hydraulic fluid supply from the pump 4 by taking priority over the other valves of the group.

In the second valve group 18, the right travelling directional control valve 38 has its inlet port connected to the center bypass line 23 in a position on the uppermost stream end of the center bypass line 23 thereby to connect the valve 38 to the pump 6. The second arm directional control valve 40 has its inlet port connected to the center bypass line 23 in a position downstream of the valve 38. The second bucket directional control valve 42 has its inlet port connected to the center bypass line 23 through a bypass line 46 in a position between the valves 38 and 40 thereby to connect the valve 42 in parallel with the valve 40. The second boom directional control valve 44 has its inlet port connected to the center bypass line 23 in a position on the downmost stream end thereof. Thus, it will be noted that the valve 38 is arranged so as to be able to receive hydraulic fluid supply from the pump 6 by taking priority over the other valves of the group.

The swing directional control valve 24 is connected to a swing motor 48. The first boom directional control valve 26 and second boom directional control valve 44 are interlocked by a linkage B to operate conjointly and both connected to a boom cylinder 50. The first arm directional control valve 28 and second arm directional control valve 40 are interlocked by a linkage C to operate conjointly and re both connected to an arm cylinder 52. The first bucket directional control valve 30 and second bucket directional control valve 42 are interlocked by a linkage D to operate conjointly and are both connected to a bucket cylinder 54. The left travelling directional control valve 32 is connected to a left travelling motor 56, and the right travelling directional control valve 38 is connected to a right travelling motor 58.

Connecting the second pump 6 to the left travelling directional control valve 32 is a bypass circuit 62 having a bypass line 60 having an on-off valve 64 mounted therein. The on-off valve 64 which is normally in a closed position is interlocked with valves 24, 26, 28 and 30 by linkages A–D so as to be brought to an open position in response to actuation of each of the valves 24, 26, 28 and 30, which are disposed in positions upstream of the left travelling directional control valve 32 in which they are able to receive hydraulic fluid supply by taking priority over the valve 32. The main lines 20 and 22 have mounted therein relief valves 66 and 68, respectively.

Operation of the embodiment shown in FIG. 1 is as follows:

(1) Travelling and Boom Operations

In the first valve group 16, since the first boom directional control valve 26 is located in an upstream position in which it is able to receive a hydraulic fluid supply by taking priority over the left travelling directional control valve 32, hydraulic fluid from the first pump 4 is all supplied to the boom cylinder 50 through the valve 26, thereby driving the boom. In the second valve group 18, since the right travelling directional control valve 38 is located in an upstream position in which it is able to receive a hydraulic fluid supply by taking priority over the second boom directional control valve 44, hydraulic fluid from the second pump 6 is supplied to the right travelling motor 58 through the valve 38. At the same time, since the on-off valve 64 is brought to an open position by the linkage B in response to actuation of the valve 26, hydraulic fluid from the pump 6 is also supplied through the bypass line 60 and left travelling directional control valve 32 to the left travelling motor 56. Thus, the left and right travelling motors 56 and 58 are driven by the hydraulic fluid supply from the second pump 6, independently of the operation of the boom cylinder 50.

(2) Travelling and Arm Operations

As is the case with the travelling and boom combined operations, hydraulic fluid from the first pump 4 is all supplied through the first arm directional control valve 28 to the arm cylinder 52, and a hydraulic fluid from the second pump 6 is supplied to the left and right motors 56 and 58 through the left and right travelling directional valves 32 and 38, respectively. Thus, the travelling operation and the arm operation can be performed independently of each other.

(3) Travelling Operation and Swing or Bucket Operation

Like the travelling and boom or arm operations, the travelling and swing or bucket operations can be performed independently of each other.

(4) Swing and Boom Operations

The first boom directional control valve 26 is connected in parallel with the swing directional control valve 24 through the bypass line 34, so that hydraulic fluid from the first hydraulic pump 4 is supplied to the swing motor 48 and boom cylinder 50. Hydraulic fluid from the second hydraulic pump 6 is supplied to the boom cylinder 50 through the second boom directional control valve 44. The swing having high inertia, the swing motor 48 tends to have a high working pressure when a swing acceleration operation is performed. However, the majority of the hydraulic fluid supplied from the pump 4 is sent through the bypass line 34 to the boom cylinder 50, so that the working pressure of the swing motor 48 during acceleration operation is kept to the level of the working pressure of the boom cylinder 50. Thus the power can be effectively utilized for performing a boom operation. If the swing directional control valve 24 were connected in such a manner that it is able to receive a hydraulic fluid supply by taking priority over the boom directional control valve 26, the swing motor 48 would have its working pressure greatly raised in performing a swing acceleration operation and render the relief valve 66 operative, thereby causing a loss of power, a reduction in efficiency and an unsatisfactory upward movement of the boom. In the embodiment shown in FIG. 1, the pressure of the bypass line 34 makes it impossible to render the swing and boom operations fully independent of each other. However, since the relief valve 66 can be kept inoperative during swing acceleration operation and no loss of power occurs, the boom can be raised to a desired high level with a high degree of efficiency.

When it is desired to perform swing and boom operations fully independently of each other, one has only to provide a construction enabling the boom operation lever to operate in two stages in such a manner that the second boom directional control valve 44 only operates in the first stage while the two boom directional control valves 26 and 44 both operate in the second stage. In this way, the swing operation can be performed fully independently of the boom operation by operation in the first stage.

(5) Swing Operation and Arm or Bucket Operation

Hydraulic fluid from the first pump 4 is all supplied to the swing motor 48 by actuation of the swing directional control valve 24. Hydraulic fluid from the second pump 6 is all supplied to the arm cylinder 52 by actuation of the arm directional control valve 40. Thus, the swing and arm operations can be performed independently of each other. Likewise, the swing and bucket operations can be performed independently of each other.

(6) Three Operations of Boom, Arm and Bucket

Hydraulic fluid from the first pump 4 is supplied to the boom cylinder 50 through the boom directional control valve 26. Since the second bucket directional control valve 42 is connected in parallel with the second arm directional control valve 40 through the bypass line 46, hydraulic fluid from the second pump 6 is supplied to the arm cylinder 52 and bucket cylinder 54 through the valves 40 and 42, respectively. This makes boom, arm and bucket operations performed simultaneously.

(7) Four Operations of Swing, Boom, Arm and Bucket

Hydraulic fluid from the first pump 4 is supplied to the swing motor 48 and boom cylinder 50 through the swing directional control valve 24 and the bypass line 34 and first boom directional control valve 26, respectively. Hydraulic fluid from the second pump 6 is supplied to the arm cylinder 52 and bucket cylinder 54 through the second boom directional control valve 40 and the bypass line 46 and second bucket directional control valve 42, respectively. Thus, the swing, boom, arm and bucket operations can be performed simultaneously.

Figure 2:
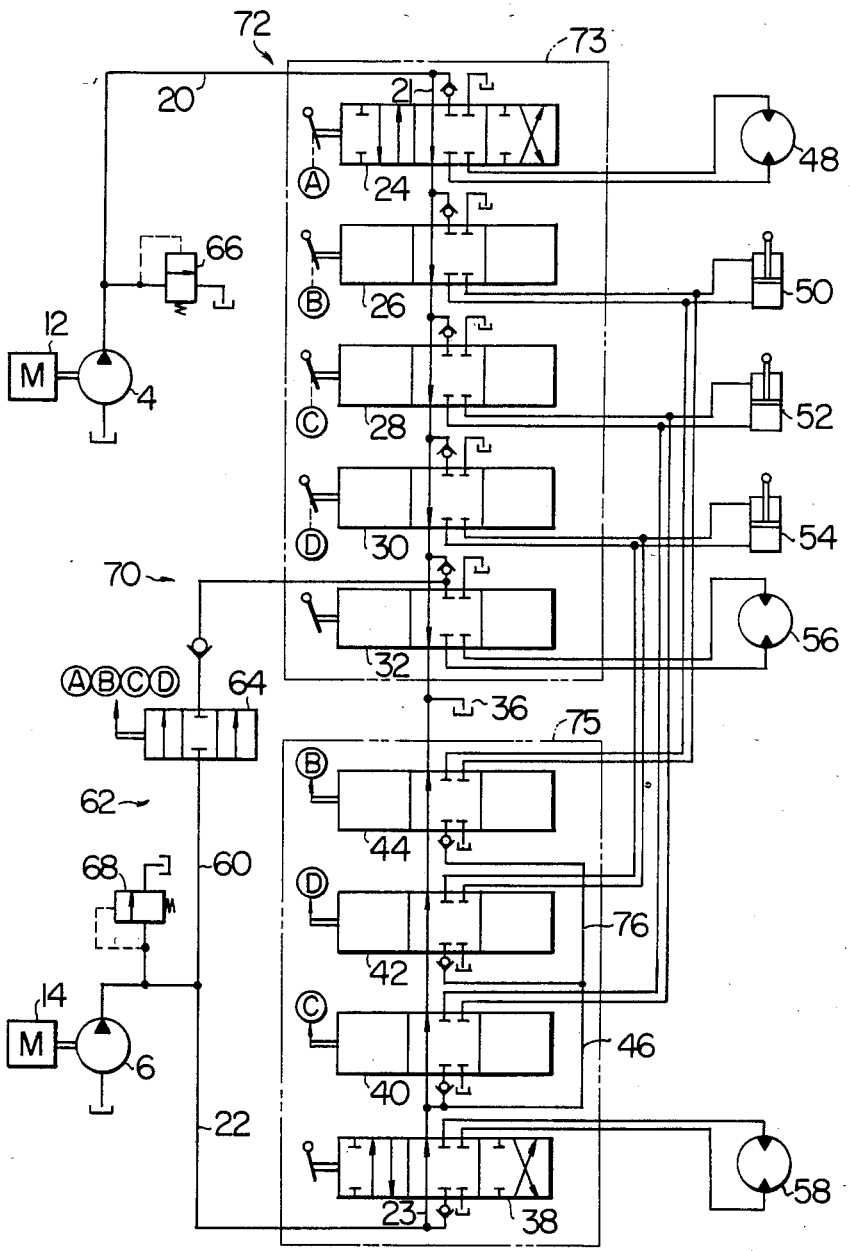
FIG. 2 is a circuit diagram of the hydraulic drive system comprising a second embodiment of the invention.

As shown in FIG. 2, a hydraulic drive system generally designated by the reference numeral 70 comprises a first hydraulic circuit generally designated by the reference-numeral 72 including a first valve group 73 in which the first boom directional control valve 26 is connected to the center bypass line 21 in a position downstream of the swing directional control valve 24. That is, the valves 24, 26, 28, 30 and 32 are connected together in tandem in the indicated order so as to be able to receive a hydraulic fluid supply from the hydraulic pump 4 by taking priority in such an order. The system 70 also comprises a second hydraulic circuit 74 including a second valve group 75 in which the second boom directional control valve 44 is, like the second bucket directional control valve 42, connected to the pump 6 through a bypass line 76 connected to the center bypass line 23 in a position between the right travelling directional control valve 38 and the second arm directional control valve 40.

Figure 3:
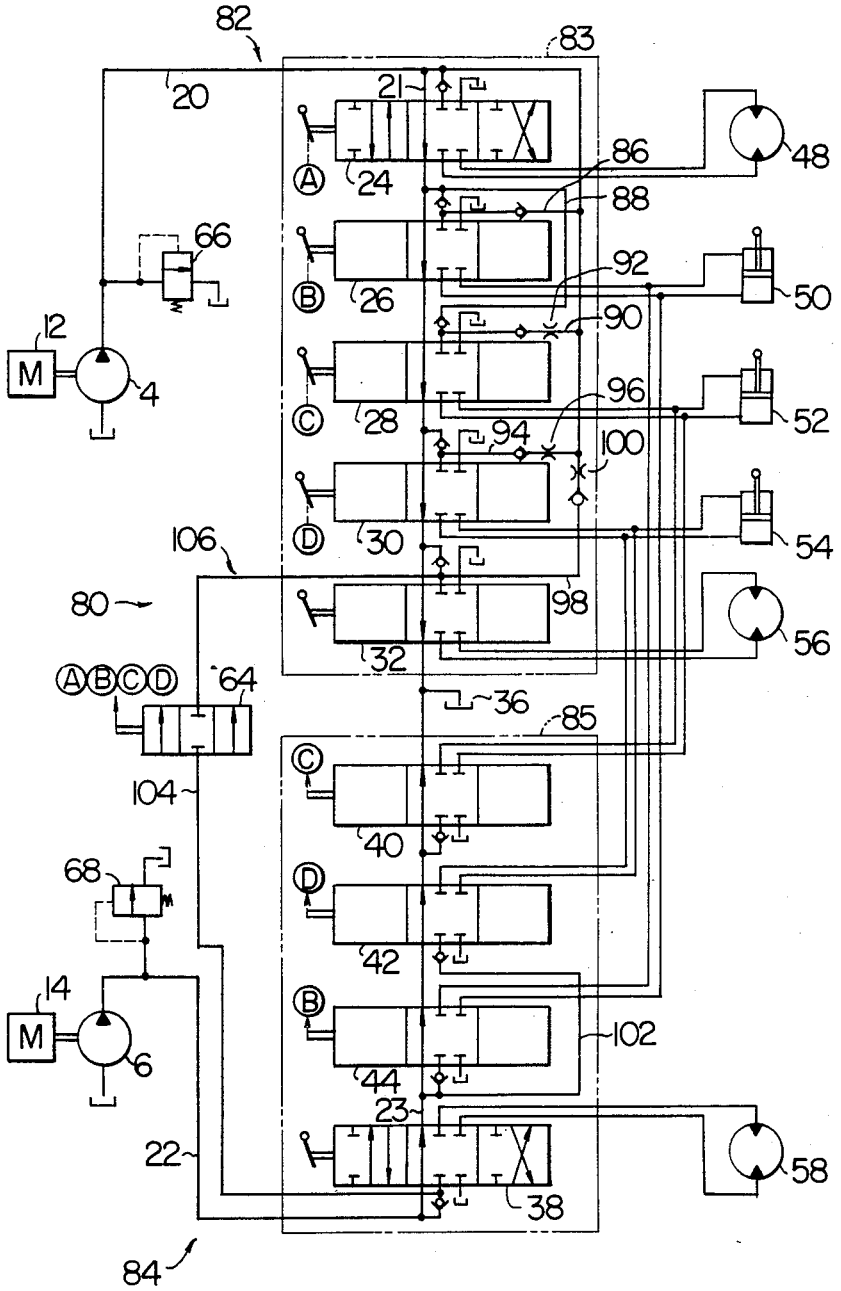
FIG. 3 is a circuit diagram of the hydraulic drive system comprising a third embodiment of the invention.

In the second embodiment shown in FIG. 2, the combined operations (1)–(7) that have been performed in the first embodiment shown in FIG. 1 can be performed substantially in like manner except that in the combined operations of swing and boom, it is impossible to avoid the occurrence of relief due to inertia of the swing. Instead, in the second embodiment, the combined operations of swing and boom can be performed fully independently of each other without actuating the operation lever in two stages as in the first embodiment. As shown in FIG. 3, hydraulic drive system generally designated by the reference numeral 80 comprises a first hydraulic circuit generally designated by the reference numeral 82 including the first hydraulic pump 4, and second hydraulic circuit generally designated by the reference numeral 84 including the second hydraulic pump 6. The pumps 4 and 6 are driven by the prime movers 12 and 14, respectively, which may be the same one or different ones. As in the first embodiment of FIG. 1, the first circuit 82 includes a first valve group 83 comprising the swing directional control valve 24, first boom directional control valve 26, first arm directional control valve 28, first bucket directional control valve 30 and left travelling directional control valve 32 and connected to the pump 4 through the main line 20. In the first valve group 83, the valves 24, 26, 28, 30 and 32 are provided with the center bypass line 21 passing therethrough in the indicated order, the center bypass line 21 being connected at one end to the main line 20 and at the other end to the tank 36. As in the first embodiment, the second circuit 84 includes a second valve group 85 comprising the right directional control valve 38, second boom directional control valve 44, second bucket directional control valve 42 and second arm directional control valve 40 and connected to the pump 6 through the main line 22. In the second valve group 85, the valves 38, 44, 42 and 40 are provided with the center bypass line 23 passing therethrough in the indicated order, the bypass line 23 being connected at one end to the main line 22 and at the other end to the tank 36.

In the first valve group 83, the swing directional control valve 24 has its inlet port connected to the center bypass line 21 in a position on the uppermost stream end thereof thereby to connect the valve 24 to the pump 4, and the first boom directional control valve 26 has its inlet port connected to the center bypass line 21 through a bypass line 86 in a position upstream of the valve 24 to thereby connect the valve 26 to the pump 4 in parallel with the valve 24. The first arm directional control valve 28 has its inlet port connected through a bypass line 88 to the center bypass line 21 in a position between the valves 24 and 26 to thereby connect the valve 28 in parallel with the valve 26. The inlet port of the first arm directional control valve 28 is also connected through a bypass line 90 to the center bypass line 21 in a position upstream of the valve 24 thereby to connect the valve 28 to the pump 4, and a restrictor 92 is mounted in the bypass line 90. The first bucket directional control valve 30 has its inlet port connected to the center bypass line 21 in a position downstream of the valve 28 and to the center bypass line 21 through a bypass line 94 in a position upstream of the valve 24 thereby to connect the valve 30 to the pump 4, and a restrictor 96 is mounted in the bypass line 94. The left travelling directional control valve 32 has its inlet port connected to the center bypass line 21 in a position downstream of the valve 30 and to the center bypass line 21 in a position upstream of the valve 24 through a bypass line 98 thereby to connect the valve 32 to the pump 4, and a restrictor 100 is mounted in the bypass line 98.

In the second valve group 85, the right traveling directional control valve 38 has its inlet port connected to the center bypass line 23 in a position at the uppermost stream end thereof thereby to connect the valve 38 to the pump 6 so as to be able to receive a hydraulic fluid supply from the pump 6 by taking priority over the other valves in the group. The second boom directional control valve 44 has its inlet port connected to the center bypass line 12 in a position downstream of the valve 38. The second bucket directional control valve 42 has its inlet port connected through a bypass line 102 to the center bypass line 23 in a position between the valves 38 and 44 to thereby connect the valve 42 in parallel with the valve 44. The second arm directional control valve 40 has its inlet port connected to the center bypass line 23 in a position at the most downstream end of the center bypass line 23.

The swing directional control valve 24 is connected to the swing motor 48. The first boom directional valve 26 and second boom directional control valve 44 are interlocked by the linkage B and are both connected to the boom cylinder 50. The first arm direction control valve 28 and second arm directional control valve 40 are interlocked by the linkage C and are both connected to the arm cylinder 52. The first bucket directional control valve 30 and second bucket directional control valve 42 are interlocked by the linkage D and both connected to the bucket cylinder 54. The left travelling directional control valve 32 is connected to the left travelling motor 56. The right travelling directional control valve 38 is connected to the right motor 58.

Connecting the second pump 6 and the left travelling directional control valve 32 is a bypass circuit 106 including a bypass line 104 connected at one end to the inlet port of the right travelling directional control valve 38 and at the other end to the inlet port of the left travelling directional control valve 32. Mounted in the bypass line 104 is the on-off valve 64 which, although normally closed, is brought to an open position by the linkages A–D in response to actuation of each of the valves 24, 26, 28 and 30 upstream of the left travelling directional control valve 32.

Operation of the third embodiment shown in FIG. 3 is as follows:

(1) Travelling and Boom Operations

In the first valve group 83, since the boom directional control valve 26 is located in an upstream position of the left travelling directional control valve 32 in the center bypass line 21 and the bypass line 98 for the valve 32 includes the restrictor 100, the majority of hydraulic fluid from the pump 4 is supplied to the boom cylinder through the valve 26, thereby driving the boom. In the second valve group 85, since the right travelling directional control valve 38 is located on the upstream side of the boom directional control valve 44 so as to be able to receive a hydraulic fluid supply by taking priority thereover, hydraulic fluid from the pump 6 is supplied to the right travelling motor 58 through the valve 38. With the on-off valve 64 being moved to its open position by the linkage B interlocked with the boom directional control valve 26, hydraulic fluid from the pump 6 is also supplied through the bypass line 104 and the left travelling directional control valve 32 to the left travelling motor 56. Thus, the left and right travelling motors 56 and 58 are essentially driven by hydraulic fluid supply from the pump 6. A small portion of hydraulic fluid from the hydraulic pump 4 flows through the bypass line 98 and restrictor 100 to the left directional control valve 32. By restricting the flow of hydraulic fluid through the restrictor 100 in such a manner that a pressure high enough or higher than is necessary to raise the boom is obtained, it is possible to allow the travelling and boom operations to be performed highly independently of each other. Moreover, when the valve 26 is actuated to raise the boom during travelling operation, the bypass line 98 and restrictor 100 function to prevent all the amount of hydraulic fluid from the pump 4 from being cut off by the valve 26, and therefore it is possible to eliminate large fluctuations in travelling speed and reduce a shock upon actuation of the valve 26, and also it is possible to minimize reduction in travelling speed after the actuation of the valve 26.

(2) Travelling and Arm Operations

As in the travelling and boom combined operations, the majority of hydraulic fluid from the pump 4 is supplied to the arm cylinder 52 through the arm directional control valve 28, and hydraulic fluid from the pump 6 is supplied through the left and right travelling directional control valves 32 and 38 to the left and right motors 56 and 58, respectively. The provision of the restrictor 100 to the bypass line 98 enables the travelling and arm operations to be performed highly independently of each other. Also, the provision of the bypass line 98 and restrictor 100 can prevent occurrence of sudden fluctuations in the travelling speed and thus reduce a shock as well as minimize a reduction in travelling speed when the valve 28 is actuated during travelling operation.

(3) Travelling Operation and Swing or Bucket Operation

As in the travelling and arm combined operations, the travelling and swing or bucket operations can be performed highly independently of each other and a shock and a reduction in travelling speed can be minimized when a swing or bucket operation is performed during a travelling operation.

(4) Swing and Boom Operations

As in the first embodiment shown in FIG. 1, actuation of the relief valve 66 due to inertia of the swing can be avoided and the energy of the hydraulic pump 4 can be effectively utilized to raise the boom. Also, by actuating the boom operation lever in two stages when necessary, it is possible to perform the swing and boom operations highly independently of each other.

(5) Swing Operation and Arm of Bucket Operation

The provision of the restrictor 92 to the bypass line 90 permits the majority of hydraulic fluid from the pump 4 to be supplied through the swing directional control valve 24 to the swing motor 48. Hydraulic fluid from the pump 6 is supplied through the second arm directional control valve 40 to the arm cylinder 52. By restricting the flow of hydraulic fluid through the restrictor 92 in such a manner that a pressure high enought to drive the swing can be obtained, it is possible to permit the swing arm operations to be performed highly independently of each other.

Also, the provision of the bypass line 90 and restrictor 92 allows hydraulic fluid from the pump 4 to flow in part, when inertia of the swing raises the working pressure of the swing motor 48 during swing acceleration, to the arm cylinder 52 through the bypass line 90 and restrictor 92. Thus, as in the swing and boom combined operations, it is possible to keep the relief valve 66 from being actuated by inertia of the swing and to effectively utilize the energy of the pump 4 to raise the arm. When the two operations need be performed completely independently of each other, one has only to actuate the arm operation lever in two stages as in the swing and boom combined operations in such a manner that the second arm directional control valve 40 is only actuated in the first stage while the two arm directional control valves 28 and 40 are actuated in the second stage. Thus, when the arm operation lever is actuated in the first stage, the swing and arm operations can be performed completely independently of each other. When the swing operation is performed simultaneously as the bucket operation, the two operations can be performed in the same manner as the swing and arm combined operations.

(6) Three Operations of Boom, Arm and Bucket

The majority of hydraulic fluid from the pump 4 is supplied to the boom cylinder 50 through the first boom directional control valve 26 and to the arm cylinder 52 through the bypass line 88 and first arm directional control valve 28, and a small portion of the hydraulic fluid is supplied to the bucket cylinder through the bypass line 94 and first bucket directional control valve 30. Hydraulic fluid from the pump 6 is supplied to the boom cylinder 50 through the second boom directional control valve 44 and to the bucket cylinder 54 through the bypass line 102 and second bucket directional control valve 42. Thus, boom, arm and bucket combined operations can be obtained.

(7) Four Operations of Swing, Boom, Arm and Bucket

Hydraulic fluid from the pump 4 is supplied to the swing motor 48 through the swing directional control valve 24, to the boom cylinder 50 through the bypass line 86 and first boom directional control valve 26, to the arm cylinder 52 through the bypass line 90 and first arm directional control valve 28, and to the bucket cylinder 54 through the bypass line 94 and first bucket directional control valve 30. Hydraulic fluid from the pump 6 is supplied to the boom cylinder 50 through the second boom directional control valve 44, and to the bucket cylinder 54 through the bypass line 102 and second bucket directional control valve 42. Thus, swing, boom, arm and bucket operations can be obtained.

(8) Other Operations

The provision of the bypass line 88 enables travelling, boom, and arm combined operations to be performed. Also, the provision of the bypass lines 86 and 92 enables swing, travelling and boom combined operations and swing, travelling and arm combined operations respectively to be performed. Particularly, the provision of the bypass line 104 enables left side travelling to be performed while performing swing operation. The combination of the bypass line 98 and throttle 100 has the effect of avoiding the occurrence of relief during swing acceleration when performing the swing and travelling combined operations.

Figure 4:
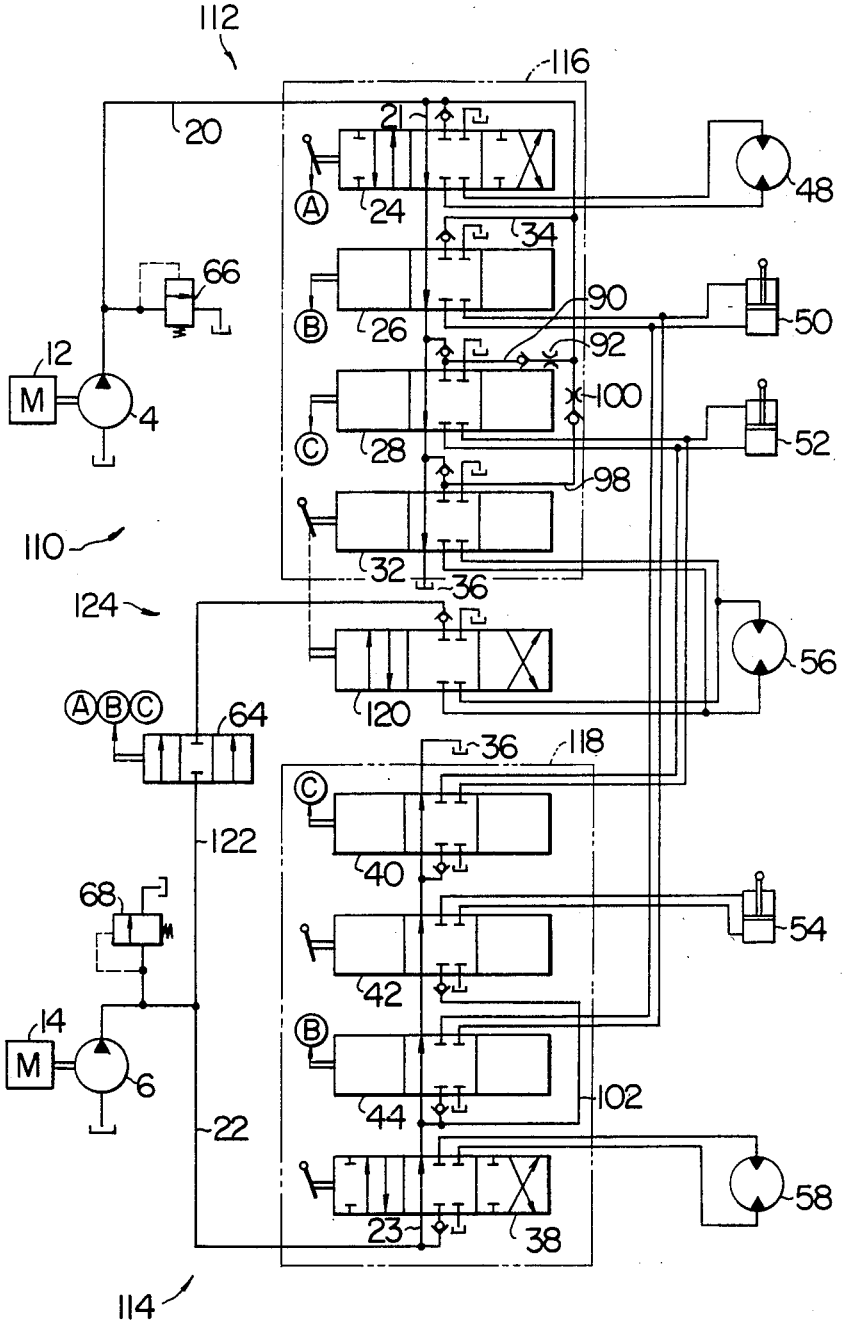
FIG. 4 is a circuit diagram of the hydraulic drive system comprising a fourth embodiment of the invention.

In the embodiment of FIG. 4, a hydraulic drive system generally designated by the reference numeral 110 comprises a first hydraulic circuit generally designated by the reference numeral 112 and a second hydraulic circuit generally designated by the reference numeral 114. The first circuit 112 comprises a first valve group 116 in which the arrangement of the elements is substantially similar to that of the embodiment shown in FIG. 3 except that the bucket directional control valve of low importance is not mounted, that the arm directional control valve 28 has its inlet port connected to the center bypass line 21, not a bypass line, in a position downstream of the bucket directional control valve 26 by attaching importance to the operation of the latter, and that no bypass circuit is mounted between the left travelling directional control valve 32 and second pump 6. The second circuit 114 comprises a second valve group 118 in which the arrangement of the elements is substantially similar to that of the embodiment shown in FIG. 3.

The system 110 further comprises an auxiliary left travelling directional control valve 120 interlocked with the left travelling directional control valve 32 but constituting a separate entity therefrom, and a bypass circuit 124 including a bypass line 122 connecting the valve 120 to the second pump 6. The on-off valve 64 mounted in the bypass circuit 124 is interlocked with the valves 24, 26 and 28 upstream of the left travelling directional control valve 32 in the center bypass line 21 by the linkages A, B and C, and is brought to an open position in response to actuation of each of the valves 24, 26 and 28. Like the other directional control valves, the auxiliary left travelling directional control valve 120 may be in the form of a six port valve. By using the valve 120 of this construction, the need to form the valve body with a connecting port for connecting the bypass line 122 to the left travelling directional control valve 32 can be eliminated.

In this embodiment, the arm directional control valve 28 has its inlet port connected to the center bypass line 21 in a position downstream of the boom directional control valve 26 as aforesaid. Due to this arrangement, hydraulic fluid flows into the arm cylinder 52 through the throttle 92 and thus the operation of the arm may be slightly reduced in speed in combined operations involving the boom and arm. In other respects, the performance of the system is substantially similar to that of the embodiment shown in FIG. 3.

Figure 5:
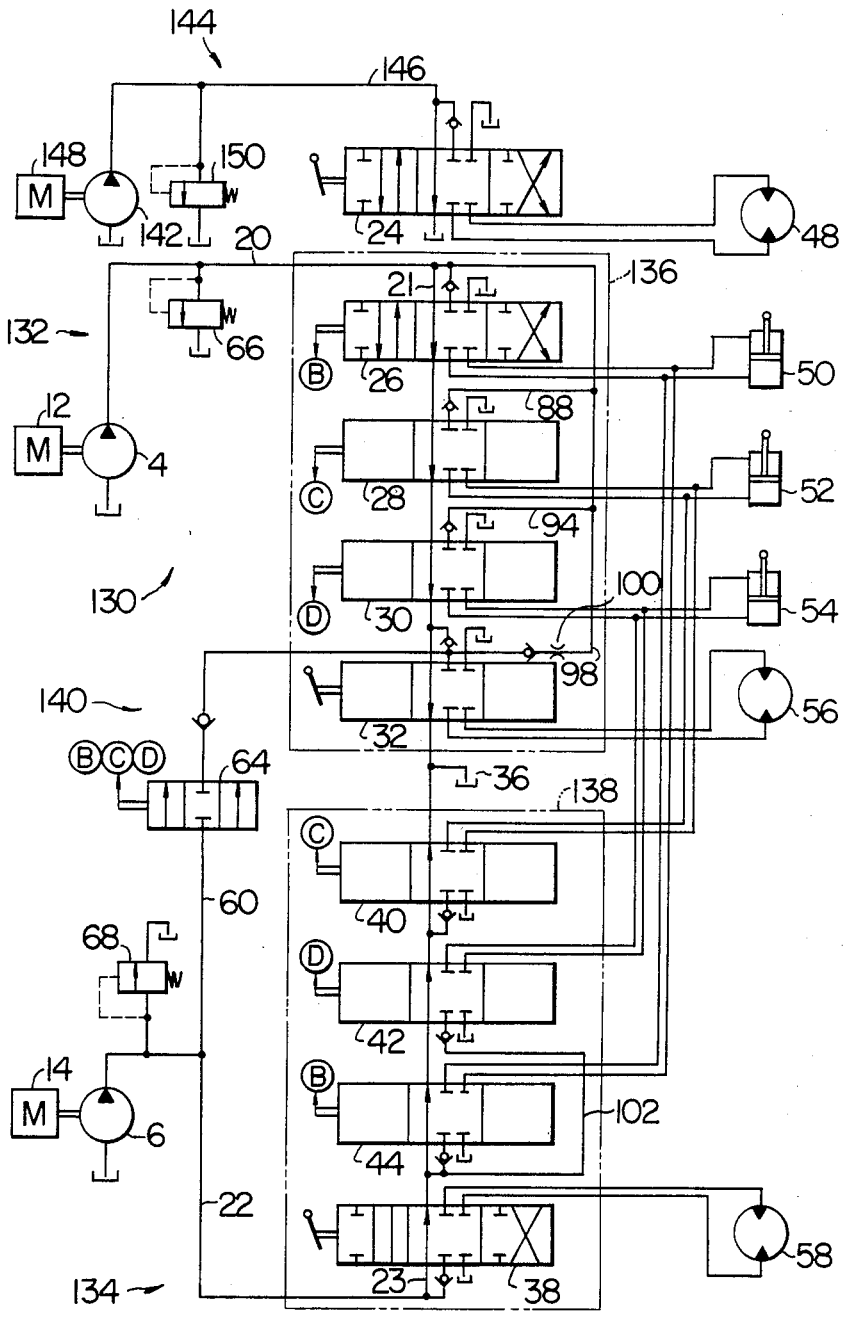
FIG. 5 is a circuit diagram of the hydraulic drive system comprising a fifth embodiment of the invention.

As shown in FIG. 5, a hydraulic drive system designated by the reference numeral 130 and comprises a first hydraulic circuit 132 and a second hydraulic circuit 134 including the first and second hydraulic pumps 4 and 6, respectively. The first hydraulic circuit 132 further includes a first valve group 136 in which the arrangement of the elements is substantially similar to that of the embodiment shown in FIG. 3 except that no swing directional control valve is mounted and that no restrictor is mounted in the bypass line 94 for the bucket directional control valve 30. The second hydraulic circuit 132 includes a second valve group 138 in which the arrangement of the elements is substantially similar to that of the embodiment shown in FIG. 3. In a bypass circuit 140 connecting the left travelling directional control valve 32 to the second pump 6, the on-off valve 64 is interlocked with the valves 26, 28 and 30 upstream of the left travelling directional control valve 32 in the center bypass line 21 by the linkages B, C and D, and is brought to an open position in response to actuation of each of the valves 26, 28 and 30.

The hydraulic drive system 130 shown in FIG. 5 further comprises a third hydraulic circuit 144 including a third hydraulic pump 142, in which the swing directional control valve 24 is connected to receive a hydraulic fluid supply from the pump 142 through a main line 146. The pump 142 is driven by a prime mover 148 which may be the same one as or different ones from the prime movers 12 and 14. A relief valve 150 is mounted in the main line 146.

It will be understood that all the combined operations described as being performed in the third embodiment can also be performed substantially in like manner in this embodiment. In this embodiment, the swing operation can be performed completely independently of the operations of other actuators.

In all the embodiment shown and described hereinabove, the directional control valves 24–32 and 38–44 are shown as being manually operated. However, the invention is not limited to this specific type of valves and valves of the hydraulic type controlled by pilot pressure signals, valves of the electric type controlled by electrical signals, valves of the mechanical type controlled by mechanical displacement signals and any other suitable valves of the known type may be used.

The bypass circuits 62, 106, 124 and 140 mount the on-off valve 64. However, this is not essential and the on-off valve 64 may be dispensed with and the bypass lines 60, 104 and 122 may be kept open at all times. When this is the case, the left and right travelling motors 56 and 58 would be communicated with each other during travelling operation with no other operations being performed. Thus, if a difference is produced in working pressure between them, a larger quantity of hydraulic pressure fluid would flow to the motor of lower working pressure, thereby preventing the left and right travelling operations being performed independently of each other.

The on-off valve 64, second boom directional control valve 44, second arm directional control valve 40 and second bucket directional control valve 42 have been described as being interlocked by the linkages A, B, C and D. However, the invention is not limited to this specific arrangement of the valves and the valves may be actuated independently by separate operation levers.

In the embodiments shown in FIGS. 1, 2, 3 and 5, the bucket directional control valve 42 of the second valve groups 18, 75, 85 and 138 may be dispensed with because this valve is low in importance.

In the embodiments shown in FIGS. 1–5, either the boom directional control valve 44 or the arm directional control valve 40 of the second valve groups 18, 75, 85, 118 and 138 may be dispensed with. In the embodiments shown in FIGS. 1–5, the bucket directional control valve 42 of the second valve group may be located upstream of the right travelling directional control valve 38 in the center bypass line when there is no need to perform combined operations including bucket and travelling operations.

The embodiment shown in FIG. 1 may be modified in such a manner that an auxiliary left travelling directional control valve may be provided in addition to the left travelling directional control valve 32 as shown in FIG. 4 and a bypass circuit may connect such auxiliary left travelling directional control valve to the second pump.

Also the embodiment shown in FIG. 1 may be modified in a manner to have a third hydraulic circuit exclusively for the swing directional control valve as is the case with the embodiment shown in FIG. 5.

What is claimed is:

1. A hydraulic drive system of civil engineering and construction machinery comprising left and right travelling members, a swing, a boom and an arm and a plurality of actuators including at least left and right travelling actuators, a swing actuator, a boom actuator and an arm actuator for activating said left and right travelling members, swing, boom and arm, respectively, of said machinery, at least a first and a second hydraulic circuits for driving said plurality of hydraulic actuators, said first circuit including a first hydraulic pump, and a first valve group having a plurality of directional control valves for controlling flow of hydraulic fluid from the first pump to the actuators associated therewith, and said second circuit including a second hydraulic pump, and a second valve group having a plurality of directional control valves for controlling flow of hydraulic fluid from the second pump to the actuators associated therewith, wherein:

said first valve group includes a first travelling directional control valve for controlling flow of hydraulic fluid to one of the left and right travelling actuators, a swing directional control valve for controlling flow of hydraulic fluid to the swing actuator, a first boom directional control valve for controlling flow of hydraulic fluid to the boom actuator, and a first arm directional control valve for controlling flow of hydraulic fluid to the arm actuator, said first travelling directional control valve being connected to the first pump in a position utmost downstream in the first valve group such that said swing, first boom and arm directional control valves can receive a hydraulic fluid supply from the first pump by taking priority over the first travelling directional control valve;

said second valve group includes a second travelling directional control valve for controlling flow of hydraulic fluid to the other of the left and right travelling actuators and at least one of a second boom directional control valve for controlling flow of hydraulic fluid to the boom actuator and a second arm directional control valve for controlling flow of hydraulic fluid to the arm actuator, said second travelling directional control valve being connected to the second pump in a position upstream of said at least one of the second boom and arm directional control valves in the second circuit so as to be able to receive a hydraulic fluid supply from the second pump by taking priority over said at least one of the second boom and arm directional control valves;

the system further comprises a bypass circuit including a bypass line extending between the second pump and the one travelling actuator, said bypass circuit being effective to allow a hydraulic fluid supply from the second pump to be received by the first travelling actuator when at least one of the directional control valves of the first valve group upstream of the first travelling directional control valve which includes the swing, the boom and arm directional control valves is actuated; and said first arm directional control valve is connected to a seventeenth bypass line connected to the first circuit in a position between the swing directional control valve and the first boom directional control valve, and said first arm directional control valve is also connected to the first pump through an eighteenth bypass line connected to the first circuit in a position upstream of the swing directional control valve, said eighteenth bypass line having flow restricting means mounted therein, whereby said first arm directional control valve is in dual parallel connection with said first boom and swing directional control valves.

2. A hydraulic drive system as claimed in claim 1, wherein said bypass circuit includes an on-off valve connected in said bypass line, said on-off valve being normally disposed in a closed position and adapted to be brought to an open position conjointly with actuation of at least one of the directional control valves of said first valve group upstream of said first travelling directional control valve.

3. A hydraulic drive system as claimed in claim 2, wherein said bypass line connects said second pump to said first travelling directional control valve.

4. A hydraulic drive system as claimed in claim 2, wherein said bypass circuit includes a third travelling directional control valve connected in said bypass line and interlocked with said first travelling directional control valve.

5. A hydraulic drive system as claimed in claim 1 or 4, wherein said at least one of second boom and arm directional control valves is interlocked with a corresponding one of said first boom and arm directional control valves.

6. A hydraulic drive system as claimed in claim 1, wherein said swing directional control valve is connected to said first pump in a position upstream of said first arm and travelling direction control valves in said first circuit so as to be able to receive a hydraulic fluid supply from the first pump by taking priority over the first arm and travelling directional control valves, and said first boom directional control valve is connected to the first pump through a second bypass line connected to the first circuit in a position upstream of said swing directional control valve whereby said first boom and swing directional control valves are connected in parallel with each other.

7. A hydraulic drive system as claimed in claim 1 or 6 in which said plurality of actuators further includes a bucket actuator for actuating a bucket of said machinery, wherein said second valve group further includes a bucket directional control valve for controlling flow of hydraulic fluid to said bucket actuator, said bucket directional control valve being connected to a third bypass line connected to the second circuit in a position between the second travelling directional control valve and the second arm directional control valve.

8. A hydraulic drive system as claimed in claim 7 in which said plurality of actuators further includes a swing actuator and a bucket actuator for actuating a swing and a bucket of said machinery, respectively, wherein said first valve group further includes a swing directional control valve for controlling flow of hydraulic fluid to said swing actuator, said swing directional control valve being connected to the first pump in a position upstream of said first boom and arm directional control valves in the first circuit so as to be able to receive a hydraulic fluid supply from the first pump by taking priority over the first boom and arm directional control valves, and said second valve group further includes a bucket directional control valve for controlling flow of hydraulic fluid to said bucket actuator, said second boom and bucket directional control valves being connected to fourth and fifth bypass lines, respectively, which are connected to the second circuit in a position between the second travelling directional control valve and second arm directional control valve.

9. A hydraulic drive system as claimed in claim 8 in which said plurality of actuators further includes a swing actuator for actuating a swing of said machinery, wherein said system further comprises a third hydraulic circuit for driving said swing actuator, said third circuit including a third hydraulic pump and a swing directional control valve for controlling flow of hydraulic fluid to said swing actuator from said third pump, and said first arm directional control valve is connected to the first pump through a sixth bypass line connected to the first circuit in a position upstream of the first boom directional control valve.

10. A hydraulic drive system as claimed in claim 9 in which said plurality of actuators further includes a bucket actuator for actuating a bucket of said machinery, wherein said second valve group further includes a bucket directional control valve for controlling flow of hydraulic fluid to said bucket actuator, said bucket directional control valve being connected to a seventh bypass line connected to the second circuit in a position between the second travelling directional control valve and the second boom directional control valve.

11. A hydraulic drive system of civil engineering and construction machinery comprising left and right travelling members, a boom and an arm and a plurality of actuators including at least left and right travelling actuators, a boom actuator and an arm actuator for activating left and right travelling members, a boom and an arm, respectively, of said machinery, at least a first and a second hydraulic circuits for driving said plurality of hydraulic actuators, said first circuit including a first hydraulic pump, and a first valve group having a plurality of directional control valves for controlling a flow of hydraulic fluid from the first pump to the actuators associated therewith, and said second circuit including a second hydraulic pump, and a second valve group having a plurality of directional control valves for controlling flow of hydraulic fluid from the second pump to the actuators associated therewith, wherein:

said first valve group includes a first travelling directional control valve for controlling flow of hydraulic fluid to one of the left and right travelling actuators, a first boom directional valve for controlling flow of hydraulic fluid to the boom actuator, and a first arm directional control valve for controlling flow of hydraulic fluid to the arm actuator, said first travelling directional control valve being connected to the first pump in a position utmost downstream in the first valve group such that said first boom and arm directional control valves can receive a hydraulic fluid supply from the first pump by taking priority over the first travelling directional control valve;

said second valve group includes a second travelling directional control valve for controlling flow of hydraulic fluid to the other of the left and right travelling actuators and at least one of a second boom directional control valve for controlling flow of hydraulic fluid to the boom actuator and a second arm directional control valve for controlling flow of hydraulic fluid to the arm actuator, said second travelling directional control valve being connected to the second pump in a position upstream of said at least one of the second boom and arm directional control valves in the second circuit so as to be able to receive a hydraulic fluid supply from the second pump by taking priority over said at least one of the second boom and arm directional control valves;

the system further comprises a bypass circuit including a bypass line extending between the second pump and the one travelling actuator, said bypass circuit being effective to allow a hydraulic fluid supply from the second pump to be received by the first travelling actuator when at least one of the directional control valves of the first valve group upstream of the first travelling directional control valve which include the boom and arm directional control valves is actuated;

wherein said first travelling direction control valve is connected to the first pump through an eighth bypass line connected to the first circuit in a position upstream of the first boom and arm directional control valves, said eighth bypass line having flow restricting means mounted therein;

whereby when at least one of said first arm and boom directional control valves is activated during travelling of the machinery with said first and second travelling directional control valves being actuated, a sudden reduction in the flow rate of hydraulic fluid supplied to said first and second travelling directional control valves and thus to said left and right travelling actuators which might cause a shock to the machinery can be avoided while keeping operation of at least corresponding one of said arm and boom actuators substantially independent from operation of said left and right travelling actuators.

12. A hydraulic drive system as claimed in claim 11 in which said plurality of actuators further includes a swing actutator for actuating a swing of said machinery, wherein said first valve group further includes a swing directional control valve for controlling flow of hydraulic fluid to said swing actuator, said swing directional control valve being connected to the first pump in a position upstream of the first travelling directional control valve in the first circuit so as to be able to receive a hydraulic fluid supply from the first pump by taking priority over the first travelling directional control valve, said said eighth bypass line being connected to the first circuit in a position upstream of the swing directional control valve.

13. A hydraulic drive system as claimed in claim 12, wherein said first boom directional control valve is connected to the first pump through a ninth bypass line connected to the first circuit in a position upstream of the swing directional control valve whereby said first boom and swing directional control valves are connected in parallel with each other.

14. A hydraulic drive system as claimed in claim 12, wherein said first arm directional control valve is connected to a tenth bypass line connected to the first circuit in a position between the swing directional control valve and the first boom directional control valve and the first boom directional control valve whereby said first arm and first boom directional control valves are connected in parallel with each other.

15. A hydraulic drive system as claimed in claim 13, wherein said first arm directional control valve is connected to an eleventh bypass line connected to the first circuit in a position between the bucket directional control valve and the first boom directional control valve whereby said first arm and first boom directional control valves are connected in parallel with each other.

16. A hydraulic drive system as claimed in claim 12, wherein said first arm directional control valve is connected to the first pump through a twelfth bypass line connected to the first circuit in a position upstream of the swing directional control valve, said twelfth bypass line having flow restricting means mounted therein.

17. A hydraulic drive system as claimed in claim 13, wherein said first arm directional control valve is connected to the first pump through a thirteenth bypass line connected to the first circuit in a position upstream of the swing directional control valve, said thirteenth bypass line having flow restricting means mounted therein.

18. A hydraulic drive system as claimed in any one of claims 14–17 in which said plurality of actuators further includes a bucket actuator for actuating a bucket of said machinery, wherein said second valve group further includes a bucket directional control valve for controlling flow of hydraulic fluid to said bucket actuator, said bucket directional control valve being connected to a fourteenth bypass line connected to the second circuit in a position between the second travelling directional control valve and the second boom directional control valve.

19. A hydraulic drive system as claimed in claim 13, wherein said first arm directional control valve is connected to a seventeenth bypass line connected to the first circuit in a position between the swing directional control valve and the first boom directional control valve, and said first arm directional control valve is also connected to the first pump through an eighteenth bypass line connected to the first circuit in a position upstream of the swing directional control valve, said eighteenth bypass line having flow restricting means mounted therein, whereby said first arm directional control valve is in dual parallel connection with said first boom and swing directional control valves.

20. A hydraulic drive system of a hydraulic excavator equipped with a swing, left and right travelling devices mounted on the swing for travelling thereof, a boom mounted on the swing for pivotal movement, an arm pivotally connected to the boom, and a bucket pivotally connected to the arm, said hydraulic drive system comprising at least a first and second hydraulic circuits for driving a plurality of hydraulic actuators, said first circuit including a first hydraulic pump and a first valve group having a plurality of directional control valves for controlling a flow of hydraulic fluid from the first pump to the actuators associated therewith, and said second circuit including a second hydraulic pump and a second valve group having a plurality of directional control valves for controlling a flow of hydraulic fluid from the second pump to the actuators associated therewith, said plurality of actuators including a swing actuator, left and right travelling actuators, boom actuator, arm actuator and bucket actuator connected to said swing, left and right travelling devices, boom, arm and bucket, respectively, for driving thereof, wherein:

said first valve group includes a first travelling directional control valve connected to one of the left and right travelling actuators for controlling a flow of hydraulic fluid thereto, a first boom directional control valve connected to the boom actuator for controlling a flow of hydraulic fluid thereto, and a first arm directional control valve connected to the arm actuator for controlling a flow of hydraulic fluid thereto, said first travelling directional control valve being connected to the first pump in a position utmost downstream in the first valve group such that said first boom and arm directional control valves can receive a hydraulic fluid supply from the first pump by taking priority over the first travelling directional control valve;

said second valve group includes a second travelling directional control valve connected to the other of the left and right travelling actuators for controlling a flow of hydraulic fluid thereto, and at least one of a second boom directional control valve connected to the boom actuator for controlling flow of hydraulic fluid thereto, and a second arm directional control valve connected to the arm actuator for controlling a flow of hydraulic fluid thereto, said second travelling directional control valve being connected to the second pump in a position upstream of said at least one of the second boom and arm directional control valves in the second circuit so as to be able to receive a hydraulic fluid supply from the second pump by taking priority over said at least one of the second boom and arm directional control valves;

the system further comprises a bypass circuit including a bypass line extending between the second pump and the one travelling actuator, said bypass circuit being effective to allow a hydraulic fluid supply from the second pump to be received by the first travelling actuator when at least one of the directional control valves of the first valve group upstream of the first travelling directional control valve which include the boom and arm directional control valves is actuated; and said first travelling direction control valve is connected to the first pump through an eighth bypass line connected to the first circuit in a position upstream of the first boom and arm directional control valves, said eighth bypass line having flow restricting means mounted therein whereby when at least one of said first arm and boom directional control valves is activated during travelling of the machinery with said first and second travelling directional control valves being actuated, a sudden reduction in the flow rate of hydraulic fluid supplied to said first and second travelling directional control valves and thus to said left and right travelling actuators which might cause a shock to the machinery can be avoided while keeping operation of at least corresponding one of said arm and boom actuators substantially independent from operation of said left and right travelling actuators.

* * * * *

UNITED STATES PATENT AND TRADEMARK OFFICE

CERTIFICATE OF CORRECTION

PATENT NO. : 4,561,824

DATED : December 31, 1985

INVENTOR(S) : Nobuya OKABE et al.

It is certified that error appears in the above-identified patent and that said Letters Patent is hereby corrected as shown below:

ON THE TITLE PAGE:

In column 1, change the assignee "Hitachi, Ltd." to read --HITACHI CONSTRUCTION MACHINERY CO., LTD.--.

Signed and Sealed this

Twenty-fifth Day of November, 1986

*Attest:*

DONALD J. QUIGG

*Attesting Officer* *Commissioner of Patents and Trademarks*